US008925468B2

(12) United States Patent
Polidoros

(10) Patent No.: US 8,925,468 B2
(45) Date of Patent: Jan. 6, 2015

(54) TABLE TOP

(71) Applicant: IHS Global Design Pty. Ltd., Rowville (AU)

(72) Inventor: Nicholas Polidoros, Rowville (AU)

(73) Assignee: IHS Global Design Pty. Ltd. (AU)

( * ) Notice: Subject to any disclaimer, the term of this patent is extended or adjusted under 35 U.S.C. 154(b) by 0 days.

(21) Appl. No.: 13/911,611

(22) Filed: Jun. 6, 2013

(65) Prior Publication Data

US 2014/0223855 A1 Aug. 14, 2014

(30) Foreign Application Priority Data

Feb. 11, 2013 (AU) ..... 2013900454

(51) Int. Cl.
*A47B 17/00* (2006.01)
*A47B 13/08* (2006.01)

(52) U.S. Cl.
CPC ..... *A47B 13/08* (2013.01); *A47B 13/083* (2013.01)
USPC ..... 108/27; 108/13

(58) Field of Classification Search
USPC ..... 108/27, 13, 153.1, 157.1, 157.16, 108/157.18, 159
See application file for complete search history.

(56) References Cited

U.S. PATENT DOCUMENTS

| | | | | |
|---|---|---|---|---|
| 1,094,443 | A | 4/1914 | Illig | |
| 1,291,375 | A | 1/1919 | Berg | |
| 1,850,420 | A * | 3/1932 | Schuldt | 273/284 |
| 1,911,779 | A | 5/1933 | Uhl | |
| 2,044,588 | A * | 6/1936 | Moore | 108/27 |
| D174,030 | S | 2/1955 | French et al. | |
| 2,900,750 | A | 8/1959 | Beulow | |
| 2,903,312 | A * | 9/1959 | Lawless | 108/62 |
| D210,606 | S | 3/1968 | Hamilton et al. | |
| D214,672 | S | 7/1969 | Ricca | |
| 3,498,654 | A | 3/1970 | Diaz et al. | |
| D225,291 | S | 12/1972 | Kastner | |
| 4,065,091 | A | 12/1977 | Ulrich | |
| D252,063 | S | 6/1979 | Montague | |
| D255,076 | S | 5/1980 | Adkinson | |

(Continued)

FOREIGN PATENT DOCUMENTS

| | | |
|---|---|---|
| AU | 2013206099 | 5/2011 |
| EM | 002182048-0001 | 2/2013 |

(Continued)

OTHER PUBLICATIONS

U.S. Appl. No. 29/457,232 of Nicholas Polidoros for "Table Top Frame", filed Jun. 7, 2013, and amended Jul. 31, 2014.

(Continued)

*Primary Examiner* — Jose V Chen
(74) *Attorney, Agent, or Firm* — Saidman DesignLaw Group, LLC

(57) ABSTRACT

A table top, including an outer frame extending around the periphery of the table top, the frame having an inner surface with a plurality of first openings provided therein, a central portion having an outer periphery receivable within the outer frame, such that together they form the upper surface of the table top, and the outer periphery of the central portion sits adjacent the inner surface of the frame, the outer periphery including a plurality of second openings aligned with the first openings, and a plurality of pins insertable to extend between the first and second openings to connect the central portion to the outer frame.

14 Claims, 6 Drawing Sheets

(56) References Cited

U.S. PATENT DOCUMENTS

| | | | | |
|---|---|---|---|---|
| D270,691 | S | 9/1983 | Tonucci | |
| D274,878 | S | 7/1984 | Kates | |
| D278,959 | S | 5/1985 | Berry | |
| 4,519,152 | A | 5/1985 | Seely et al. | |
| 4,529,278 | A | 7/1985 | Nugent | |
| D335,055 | S | 4/1993 | Game | |
| D357,374 | S | 4/1995 | Rabe | |
| D363,176 | S | 10/1995 | Berry et al. | |
| 5,497,597 | A * | 3/1996 | Elzenbeck | 52/782.24 |
| 5,634,411 | A * | 6/1997 | Chasan | 108/153.1 |
| D381,845 | S | 8/1997 | Thomas | |
| D391,788 | S | 3/1998 | Hutton | |
| 6,123,031 | A * | 9/2000 | Hayman-Chaffey | 108/27 |
| D440,080 | S | 4/2001 | Suzuki | |
| D443,442 | S | 6/2001 | Hutton | |
| D445,605 | S | 7/2001 | Mourgue | |
| D445,606 | S | 7/2001 | Mourgue | |
| D454,732 | S | 3/2002 | Frenkler et al. | |
| D468,562 | S | 1/2003 | Chang | |
| D486,015 | S | 2/2004 | de Blois | |
| 6,739,271 | B1 * | 5/2004 | Hancock | 108/90 |
| 6,823,804 | B2 * | 11/2004 | Arnell | 108/90 |
| 6,899,040 | B2 * | 5/2005 | Johnson | 108/153.1 |
| D549,490 | S | 8/2007 | Brimacombe et al. | |
| D561,495 | S | 2/2008 | Kreiss | |
| 7,341,307 | B2 * | 3/2008 | Parker et al. | 297/119 |
| 7,476,436 | B2 | 1/2009 | Armstrong | |
| D637,663 | S | 5/2011 | Boutchee | |
| 8,092,112 | B2 * | 1/2012 | Borgman et al. | 403/231 |
| 2005/0223611 | A1 | 10/2005 | Dennis | |
| 2009/0281910 | A1 | 11/2009 | D'Amica | |

FOREIGN PATENT DOCUMENTS

| | | |
|---|---|---|
| EM | 002182048-0002 | 2/2013 |
| EM | 002182048-0003 | 2/2013 |
| EM | 002182048-0004 | 2/2013 |
| GB | 387188 | 2/1933 |
| WO | 97/32503 | 9/1997 |

OTHER PUBLICATIONS

Forbes Industries, EcoFlex Tables Catalogue, © 2013.

* cited by examiner

TABLE TOP

CROSS-REFERENCE TO RELATED APPLICATIONS

This application claims priority from Australian Patent Application No. 2013900454, filed Feb. 11, 2013, which is expressly incorporated by reference herein.

FIELD OF THE INVENTION

The present invention relates to table tops, specifically those used in banquet and catering environments.

BACKGROUND OF THE INVENTION

Hotels, function centres and other venues that hold events, will purchase a large number of similar style tables that can be used for display, buffet or serving purposes. Different events often require a different style of decor or furnishing. A venue may therefore house a number of different styles of tables, or cover the tables with table clothes or drapery. It is a desired object of the invention to provide an alternative flexible table top for event venues.

The frequent use of these tables over time can result in the surfaces of the table tops becoming worn. The wear is often limited to or worse on the table top than on the frames. To replace an entire table can be costly and therefore it is a desired object of the invention to provide a table top that at least ameliorates such disadvantages.

Reference to any prior art in the specification is not, and should not be taken as, an acknowledgment or any form of suggestion that this prior art forms part of the common general knowledge in Australia or any other jurisdiction or that this prior art could reasonably be expected to be ascertained, understood and regarded as relevant by a person skilled in the art.

SUMMARY OF THE INVENTION

In a broad form of the invention, there is provided a table top whereby a central portion of the table top is able to be removed from an outer frame and replaced with a new table top. The table top preferably has no externally visible fasteners.

Accordingly, the present invention provides a table top, including:

an outer frame extending around the periphery of the table top, the frame having an inner surface with a plurality of first openings provided therein;

a central portion having an outer periphery receivable within the outer frame, such that together they form the upper surface of the table top, and the outer periphery of the central portion sits adjacent the inner surface of the frame, the outer periphery including a plurality of second openings aligned with the first openings; and a plurality of pins insertable to extend between the first and second openings to connect the central portion to the outer frame.

Advantageously, the outer frame is of a tubular cross-section, such as square tubular steel or aluminium, such that the first openings provide access into the interior void of the tubular frame elements.

Preferably, the central portion is a solid construction, such that the second openings open into channels formed in the side of the central portion. The pins may be of the same or lesser length than the channels, such that they may be fully retracted within the channels to allow the central portion to be inserted within the outer frame.

Preferably, the pins are spring loaded, such that they are able to slide within the channels to a retracted position to allow the central portion to be inserted within the outer frame. The springs may then bias the pins outward to an extended position such that they extend into the first openings. The springs may be attached to the end of the pins, or may freely float within the channels.

Advantageously, the central portion is a sliding fit with the outer frame such that there a minimal gaps between the central portion and the outer frame.

The outer frame and central portion may be any shape, but are typically rectangular. At least one pin may be provided on each side of a rectangular table top; however it will be appreciated that this will greatly depend on the dimensions of the table top. Circular constructions may also be utilised.

The construction is preferably such that no fasteners are visible when assembled. The table top may be reversible, such that either surface can be the upper surface. The two opposing surfaces of the central portion may have different finishes, such that the table top is reversible.

The central portion is preferably made from a slab of timber, but may be any other suitable material, such as plastic, glass, stone or alternative laminates.

In an embodiment of the invention, the pins may be metallic, such that a magnet may be used to move them from the extended position back to the retracted position to enable the central portion to be removed and replaced. Alternatively, the pins may have a weakness line, such that on exertion of a predetermined level of downward force to the central portion, the pins shear allowing the central portion to be removed. Alternatively, the central portion may be removed by cutting the central portion to remove it from the frame for insertion of a new central portion within the original frame.

Further aspects of the present invention and further embodiments of the aspects described in the preceding paragraphs will become apparent from the following description, given by way of example and with reference to the accompanying drawings.

BRIEF DESCRIPTION OF THE DRAWINGS

The invention will now be described, by way of example only, with reference to the accompanying drawings, in which.

DETAILED DESCRIPTION OF THE EMBODIMENTS

Figure 1:
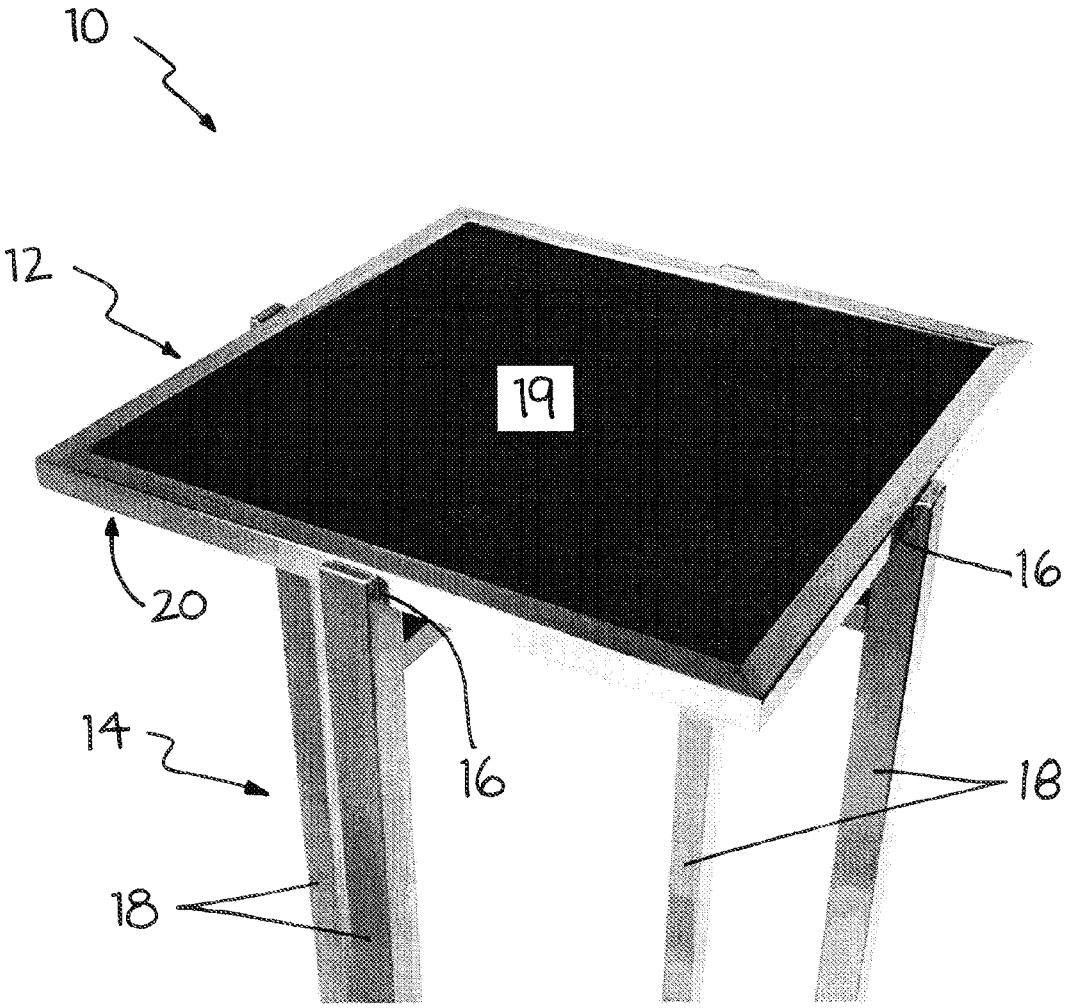
FIG. 1 is a perspective top view of a table top according to a first embodiment of the invention, seated in a stand.

A table 10 is shown in FIG. 1 and includes a table top 12 that sits on a stand 14 such that it can be removed and the stand 14 can be folded for storage. The table top 12 sits within cut out sections 16 in the upper ends of the legs 18 of the stand 14, such that the table top 12 is not affixed to the stand 14 and is reversible whereby either opposing surface 19, 20 can form the upper surface of the table 10.

Figure 2:
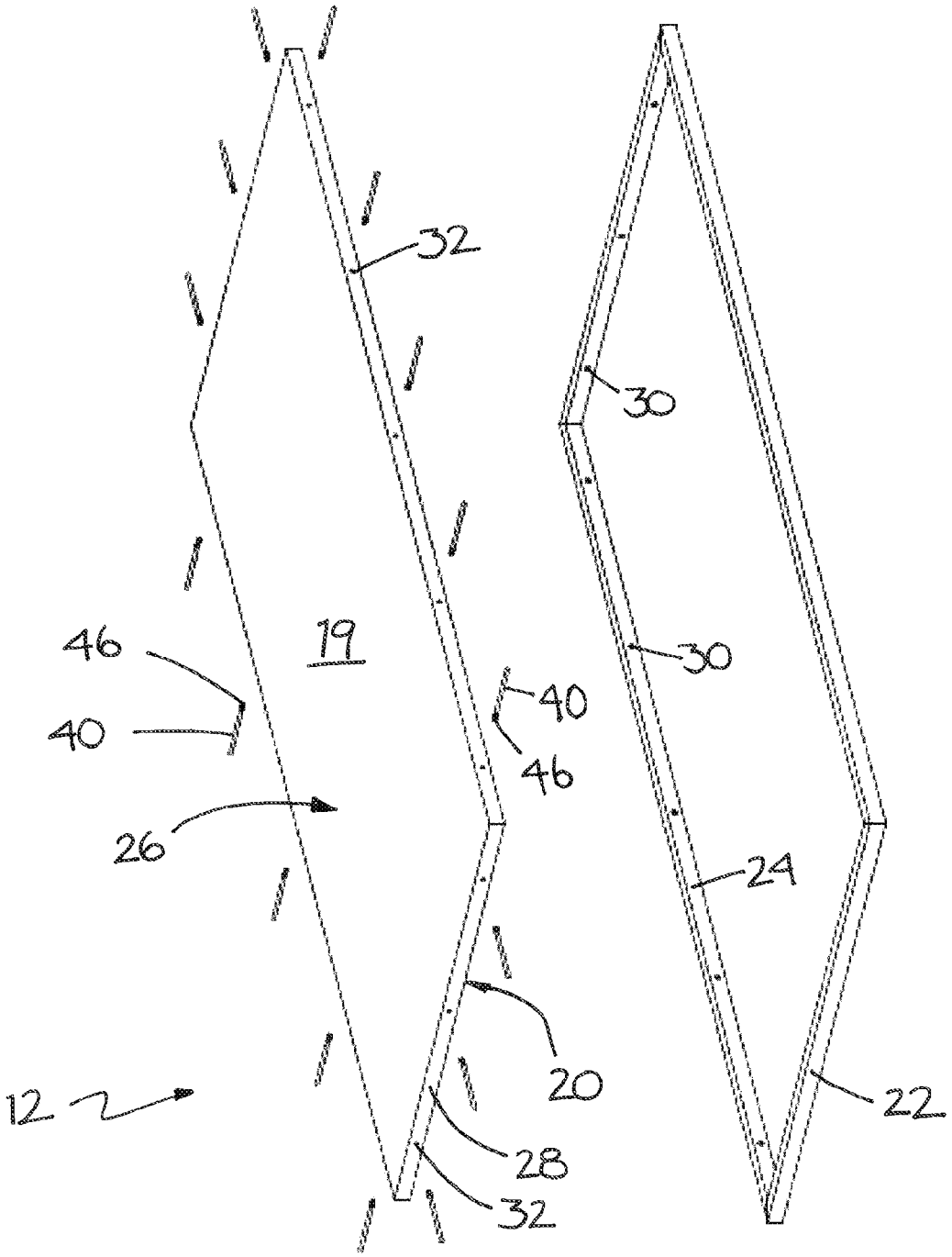
FIG. 2 is a perspective exploded view of a table top according to second embodiment.
Figure 3:
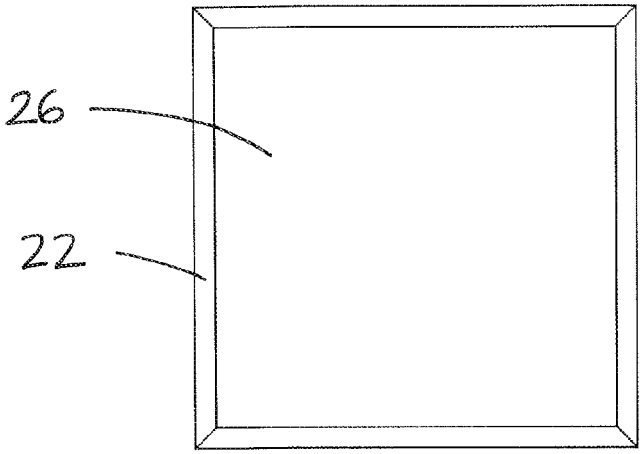
FIG. 3 is a top view of a table top according to a third embodiment.
Figure 4:
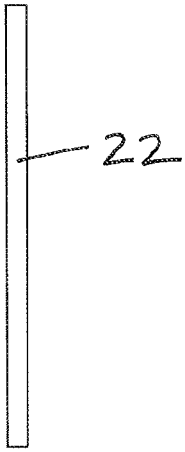
FIG. 4 is a side view of the table top of FIG. 3.
Figure 5:
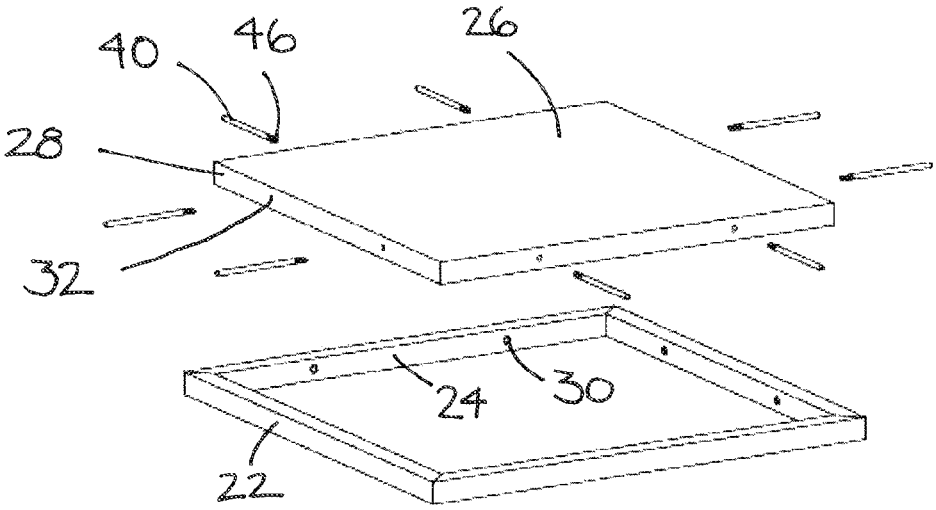
FIG. 5 is a perspective exploded view of the table top of FIG. 3.
Figure 6:
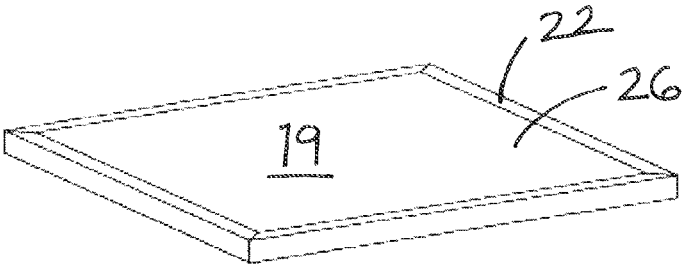
FIG. 6 is a perspective view of the table top of FIG. 3.

The table top 12 includes an outer frame 22 that extends around the periphery of the table top 12. In the embodiments illustrated, the table top 12 is rectangular (as shown in FIG. 2) or square (as shown in the remaining Figures); however, it will be appreciated that any shape could be made.

The outer frame 22 has an inner surface 24. A central portion 26 is of matching dimensions to the inner surface 24, such that the outer periphery 28 of the central portion 26 slidingly fits within the inner surface 24.

The inner surface 24 of the outer frame 22 and the outer peripheral surface 28 of the central portion 26, which sit adjacent one another when assembled, both have aligned first and second openings 30, 32, respectively. These openings 30, 32 are typically evenly spaced along all of the edges of the table top and frame, however it will be appreciated that uneven spacing may also be utilised.

The outer frame 22 is made from square tubular steel in the embodiment illustrated, such that it is hollow. The openings 24 therefore open into and provide a passage into the hollow centre 34 of the outer frame 22, as best seen in FIGS. 7A-7C and FIG. 10. The table top 26 is preferably solid, such that the openings 32 open into channels 36 having a closed end 38 (see FIG. 10).

A plurality of pins 40 are provided that have a first end 42 receivable within the first opening 30 and a second end 44 receivable within the second opening 32. Attached to the second end 44 is a spring 46 that is insertable within the channel 36. The spring 46 biases the pin 40 into an extended position (shown in FIGS. 7C through 10) such that it extends through the opening 30 and into the hollow interior 34 of the outer frame 22.

Figure 7A:
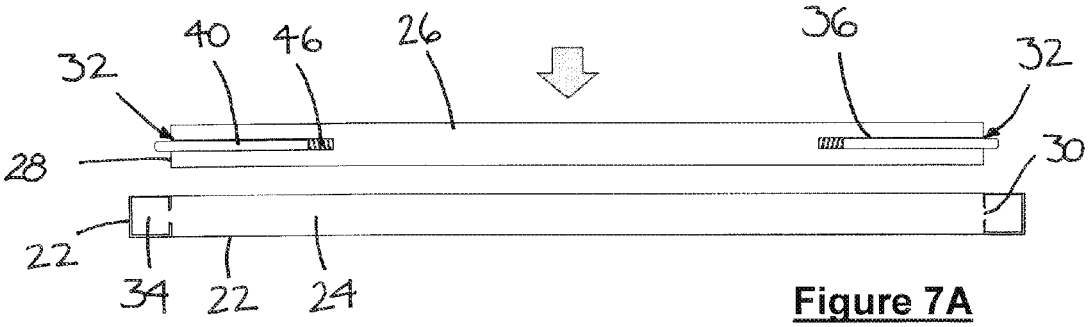
FIGS. 7A, 7B and 7C are cross-sectional side views of the table top of FIG. 3, progressively illustrating the insertion of the central portion into the frame.
Figure 7B:
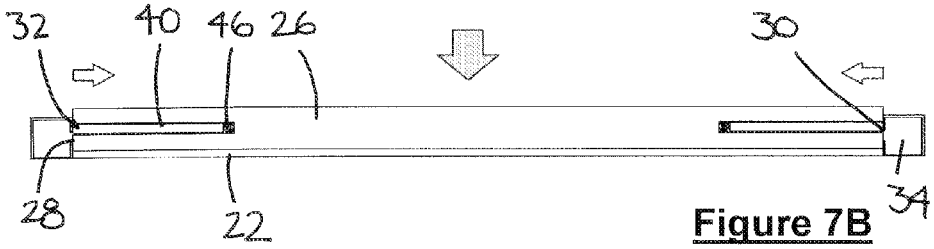
Figure 7C:
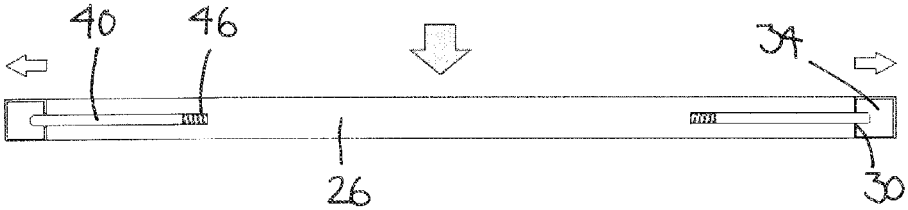
Figure 8:
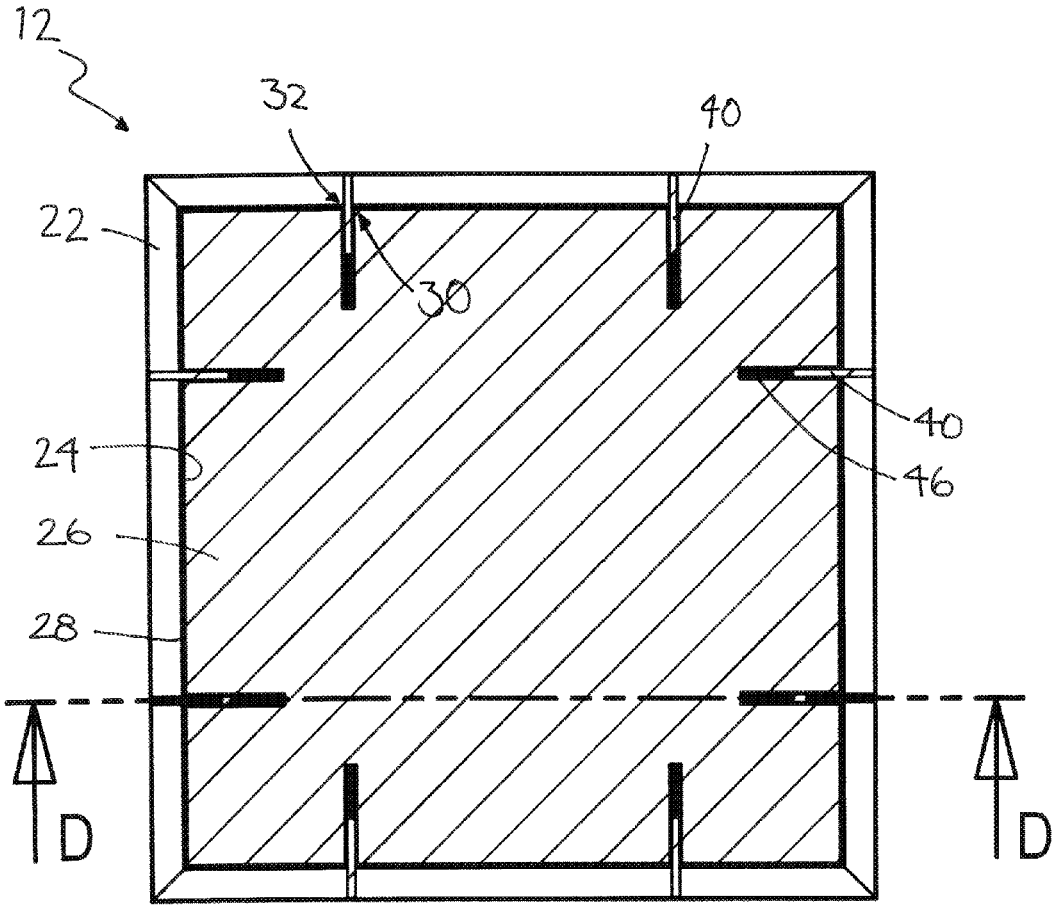
FIG. 8 is a cross-sectional top view of the table top of FIG. 3.
Figure 9:
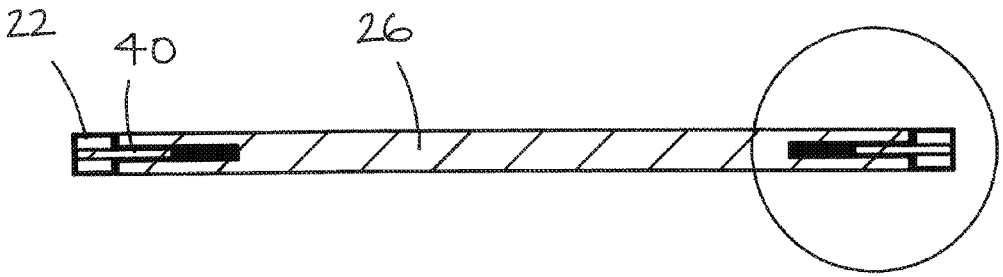
FIG. 9 is a cross-sectional side view through line D-D of FIG. 8.
Figure 10:
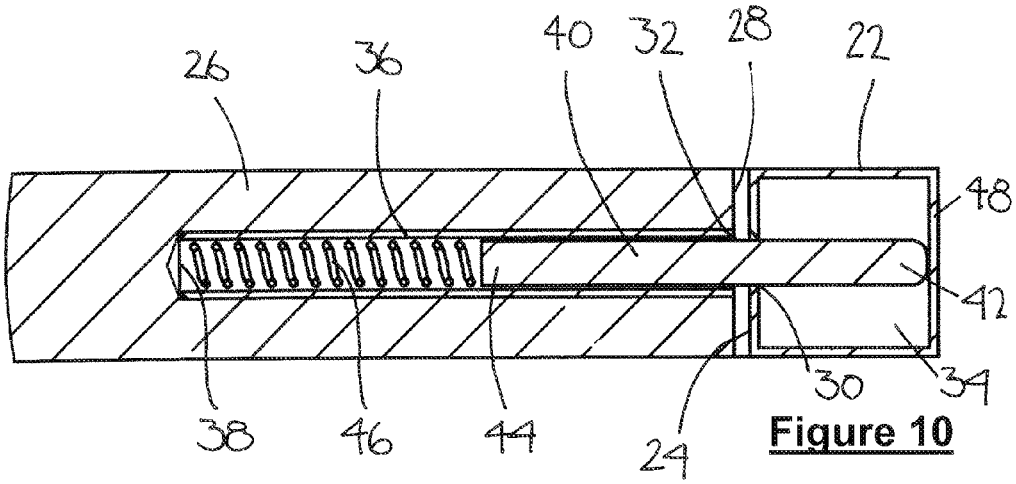
FIG. 10 is a close up view of area E of FIG. 9.

To assemble the table top 12, the pins 40 are inserted with the second ends 44 into the channel 36, with the springs 46 abutting against the closed ends 38, as shown in FIG. 7A. The central portion 26 is aligned with the outer frame 22 and lowered. The spring loaded pins 40 are then pushed against the spring 46's bias, whereby the length of the pin 40 is less than the length of the channel 36 so that on retraction it is fully housed within the channel 36, as shown in FIG. 7B. Whilst the pins 40 are in the retracted position the central portion 26 can be further lowered or pushed downwards, until the pins 40 align with the openings 30 in the outer frame 22, as shown in FIG. 7C. The springs 46 then bias the pins 40 outwardly, sliding through the openings 30. This engagement means that the central portion 26 and the outer frame 22 form the unitary structure of the table top 12. To improve stability of the connection, the pins first end 42 of the pins 40 preferably extend into the outer frame 22 until they abut against the outer wall 48 of the outer frame 22.

The aesthetic appeal of this construction is that no fasteners are visible when assembled. All connections between the central portion 26 and the outer frame 22 are internal providing an external seamless appearance.

To remove the central portion 26 from the outer frame 22 the central portion 26 would typically be destroyed, by cutting through it such that it can be drawn off the pins 40. An alternative method may be to make the pins metallic, such that a magnet can be used to draw the pins 40 into a retracted position to enable the central portion 26 to be removed. Another alternative method is to cut the pins 40 where they intersect between the inner surface 24 and outer surface 28. Another alternative is for the pins to have a weakness line at the intersection point, such that an exertion of downward pressure would shear the pins at the weakness line.

When the central portion 26 surfaces 19, 20 become scratched or stained, or are required to be changed for stylistic reasons, a users is not required to purchase an entire new table top 12. The existing central portion 26 may be removed and a new central portion inserted into the existing outer frame 22. The advantage of this system is that the cost to replace an entire table top 12 would be in the order of $750. However, to simply replace the central portion 26 would cost in the order of $430. This allows event venues to cost effectively refurbish tables with damaged table tops or to change the entire aesthetic appearance of their tables by replacing the central portion 26 with one having a different appearance.

It will be understood that the invention disclosed and defined in this specification extends to all alternative combinations of two or more of the individual features mentioned or evident from the text or drawings. All of these different combinations constitute various alternative aspects of the invention.

The invention claimed is:

1. A table top, including:

an outer frame extending around the periphery of the table top, the frame having an inner surface and an opposing outer surface, whereby a plurality of first openings are provided in the inner surface;

a central portion having an outer periphery receivable within the outer frame, such that together they form two opposing surfaces of the table top, and the outer periphery of the central portion sits adjacent the inner surface of the frame, the outer periphery including a plurality of second openings aligned with the first openings; and a plurality of pins insertable to extend between the first and second openings to connect the central portion to the outer frame, such that all connections between the central portion and the outer frame are internal to the table top, wherein the table top is positionable and reversible on a stand whereby either opposing surface can form the upper surface of the table, and whereby the central portion is removable and replaceable in the outer frame.

2. A table top according to claim 1, wherein the outer frame is of a tubular cross-section, such that the first openings provide access into an interior void of the outer frame.

3. A table top according to claim 1, wherein the central portion is a solid construction, such that the second openings open into channels formed in the side of the central portion.

4. A table top according to claim 3, wherein the pins are of the same or lesser length than the channels, such that they may be fully retracted within the channels to allow the central portion to be inserted within the outer frame.

5. A table top according to claim 4, wherein the pins are spring loaded, such that they are able to slide within the channels to a retracted position to allow the central portion to be inserted within the outer frame.

6. A table top according to claim 5, wherein the springs bias the pins outward to an extended position such that they extend into the first openings.

7. A table top according to claim 6, wherein the springs are attached to the end of the pins.

8. A table top according to claim 5, wherein the springs are attached to the end of the pins.

9. A table top according to claim 1, wherein no fasteners are visible when assembled.

10. A table top according to claim 1, wherein the two opposing surfaces of the central portion have different finishes, such that the table top is reversible.

11. A table top according to claim 1, wherein the pins are metallic, such that a magnet may be used to move them from the extended position back to the retracted position to enable the central portion to be removed and replaced.

12. A table top according to claim 1, wherein the pins have a weakness line, such that on exertion of the predetermined level of downward force to the central portion, the pins shear allowing the central portion to be removed.

13. A table top according to claim 1, wherein the central portion is able to be removed by cutting the central portion to remove it from the frame for insertion of a new central portion within the original frame.

14. A table top, including:

an outer frame extending around the periphery of the table top, the frame having an inner surface and an opposing outer surface, whereby a plurality of first openings are provided in the inner surface;

a central portion having an outer periphery receivable within the outer frame, such that together they form two opposing surfaces of the table top, and the outer periphery of the central portion sits adjacent the inner surface of the frame, the outer periphery including a plurality of second openings aligned with the first openings;

a plurality of pins insertable to extend between the first and second openings to connect the central portion to the outer frame, wherein the outer frame is of a tubular cross-section, such that the first openings provide access into an interior void of the outer frame.

* * * * *